US007527495B2

(12) United States Patent
Yam et al.

(10) Patent No.: US 7,527,495 B2
(45) Date of Patent: May 5, 2009

(54) COOPERATING BRIDGE BURNER SYSTEM

(75) Inventors: Siu Hun P. Yam, Chattanooga, TN (US); William M. Pryor, Springfield, TN (US); Bernard Dane, Veigné (FR)

(73) Assignee: Burner Systems International, Inc., Chattanooga, TN (US)

( * ) Notice: Subject to any disclaimer, the term of this patent is extended or adjusted under 35 U.S.C. 154(b) by 461 days.

(21) Appl. No.: 10/967,537

(22) Filed: Oct. 18, 2004

(65) Prior Publication Data

US 2005/0142511 A1 Jun. 30, 2005

Related U.S. Application Data

(60) Provisional application No. 60/536,590, filed on Jan. 15, 2004, provisional application No. 60/513,055, filed on Oct. 21, 2003.

(51) Int. Cl.
*F23D 14/06* (2006.01)
*F23D 14/10* (2006.01)

(52) U.S. Cl. ..... 431/283; 431/60; 431/278; 431/263; 431/354; 431/264; 431/266; 126/40

(58) Field of Classification Search ..... 431/60, 431/61, 254, 256, 257, 263, 278–285; 239/552.5, 239/548, 555, 567, 561, 557, 549, 556; 126/39 R–50
See application file for complete search history.

(56) References Cited

U.S. PATENT DOCUMENTS

| | | | | | |
|---|---|---|---|---|---|
| 545,360 | A | * | 8/1895 | Hibberd | 239/553.5 |
| 567,659 | A | * | 9/1896 | Ruppel | 431/225 |
| 747,474 | A | * | 12/1903 | Partridge | 126/40 |
| 847,210 | A | * | 3/1907 | Springer et al. | 431/278 |
| 1,058,104 | A | * | 4/1913 | Robinson | 431/283 |
| 1,130,747 | A | * | 3/1915 | Lazano | 431/278 |
| D53,874 | S | * | 10/1919 | Barber | D23/415 |
| D53,918 | S | * | 10/1919 | Kerr et al. | D23/415 |
| D53,919 | S | * | 10/1919 | Kerr et al. | D23/415 |
| D54,098 | S | * | 11/1919 | Kerr et al. | D23/415 |
| 1,328,589 | A | * | 1/1920 | Roberts | 431/278 |
| 1,550,005 | A | * | 8/1925 | Belkin | 431/256 |
| 1,618,024 | A | * | 2/1927 | Roberts | 239/549 |

(Continued)

FOREIGN PATENT DOCUMENTS

| | | | |
|---|---|---|---|
| DE | 42 13 197 | * | 4/1993 |

(Continued)

OTHER PUBLICATIONS

Keek Kitchen Appliances; Britannia; On-Line Catalog of Britannia Range Cookers from www.keek-kitchen-appliances.co.uk; Feb. 3, 2005; p3.

*Primary Examiner*—Carl D Price
(74) *Attorney, Agent, or Firm*—Stephen J. Stark; Douglas T. Johnson; Miller & Martin PLLC

(57) ABSTRACT

A multiple gas burner assembly has two burners spaced apart by a bridge burner. An axis extending through the first and third burner intersects the perimeter of the bridging second burner. The second burner provides a means for providing a substantially continuous flame perimeter and continuous heating intermediate the first burner and third burner when the three burners are lit.

17 Claims, 6 Drawing Sheets

U.S. PATENT DOCUMENTS

| | | | | | |
|---|---|---|---|---|---|
| 1,642,153 | A | * | 9/1927 | Kemp | 431/180 |
| 2,300,560 | A | * | 11/1942 | Faber | 236/1 E |
| 2,985,381 | A | * | 5/1961 | Cadella | 239/280 |
| 3,386,432 | A | * | 6/1968 | Hauson | 126/41 R |
| 3,638,635 | A | * | 2/1972 | Drennan | 126/41 R |
| 4,305,372 | A | * | 12/1981 | Hahn | 126/41 R |
| 4,478,205 | A | * | 10/1984 | Koziol | 126/25 R |
| 5,083,915 | A | * | 1/1992 | Riehl | 431/264 |
| 5,099,822 | A | * | 3/1992 | Cramer et al. | 126/39 BA |
| 5,133,658 | A | | 7/1992 | Le MonnierdeGouville | |
| 5,328,357 | A | * | 7/1994 | Riehl | 431/266 |
| 5,842,849 | A | | 12/1998 | Huang | |
| 5,875,974 | A | * | 3/1999 | Kwiatek | 239/554 |
| 6,132,205 | A | | 10/2000 | Harneit | |
| 6,263,868 | B1 | * | 7/2001 | Koch et al. | 126/39 R |
| 6,325,619 | B2 | | 12/2001 | Dane | |
| 6,332,460 | B1 | | 12/2001 | Paesani | |
| 2001/0010897 | A1 | * | 8/2001 | Dane | 431/266 |

FOREIGN PATENT DOCUMENTS

| | | | |
|---|---|---|---|
| DE | 296 18 377 | * | 7/1997 |
| DE | 196 31 503 | * | 10/1997 |
| DE | 197 45 767 | * | 3/1999 |
| JP | 07-42955 | * | 2/1995 |
| JP | 10-68506 | * | 3/1998 |
| JP | 10-141615 | * | 5/1998 |

* cited by examiner

COOPERATING BRIDGE BURNER SYSTEM

RELATED APPLICATIONS

This application claims priority and benefit of the filing date of U.S. Provisional Application Ser. No. 60/513,055 filed on Oct. 21, 2003 and Ser. No. 60/536,590 filed Jan. 15, 2004.

FIELD OF THE INVENTION

The present invention relates to gas cooking appliances, referred to generally as cookers, and which may be in the form of cook tops, stoves, ranges, or the like, and more specifically, to a bridge burner between two other conventional burners and a coordinating approach for operating the burners to provide a variety of heating configurations at the discretion of the operator of the cooker.

BACKGROUND OF THE INVENTION

Traditional burners located on a cook top are typically spaced apart and are not designed to cooperate with one another to accommodate various shapes and designs of cooking implements. Each burner is normally capable of providing at least 4,000 BTU on a high setting, however, a wide range of burner heating capacities are available.

The flame orifices or ports of adjacent and non-concentric burners are usually spaced at least 6 inches, and more commonly 8 or 10 inches apart. This provides sufficient space so that the flames of the adjacent burners do not interfere with one another and so that pots placed on grates above each burner are not significantly heated by the other nearby burners. When it is desired to utilize adjacent burners for a very large pot or griddle, there may be a cold spot between the flame ports of the adjacent burners due to the substantial spacing. Some burners have previously been specially shaped in an ovular ring to heat griddles or long fish pans, for instance, such as those depicted in GB 2,292,453. However, such burners have a perimeter of flame ports that extends to such a length that the burners are unsuitable for cooking of smaller pots and therefore the griddle or fish burners tend to be for dedicated use, and require additional space on a conventional cook top.

U.S. Pat. No. 6,325,619 illustrates a cooperating burner system with multiple concentric gas rings. This patent illustrates an effective design for separately controlling inner and outer gas burners and has been utilized for Asian cooking in connection with wok-type kitchenware.

While the use of concentric rings of cooperating gas burners is known in the art, there is not believed to have been any effort to create a system for bridging the application of heat between non-concentric, non-adjacent burners. Specifically, there is not believed to be any prior art device or method for increasing the perimeter of flame to effect a bridge portion of flames between two independently operable burners.

Accordingly, a new burner assembly and method of utilizing burners is needed.

SUMMARY OF THE INVENTION

It is therefore an object of the invention to provide cooperating burners that allow the user to select the outer perimeter of flames to be provided by the burners.

It is a further object of the invention to provide a bridge between the ordinarily positioned adjacent burners of a cook top to allow the user to select the desired cooking area and flame perimeter.

Accordingly, a new multiple gas burner design is shown and described herein which relies on a plurality of separately controllable burners capable of cooperation with one another to adjust the perimeter of the flame produced. This multiple gas burner assembly is comprised of about three gas burners arranged in a non-concentric, and preferably linear relationship to one another. The gas burners preferably cooperate to provide a substantially continuous flame perimeter. Adjacent burners preferably do not have opposing flame ports which would result in interference with flames directed from an adjacent burner. In the preferred embodiment, there are no orifices along a center line of the burners directed toward another burner. Single or multiple controllers allow a user to select one, two, or three of the burners to provide flames under independent control and thereby supply a specific flame perimeter selected by the cook top operator.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
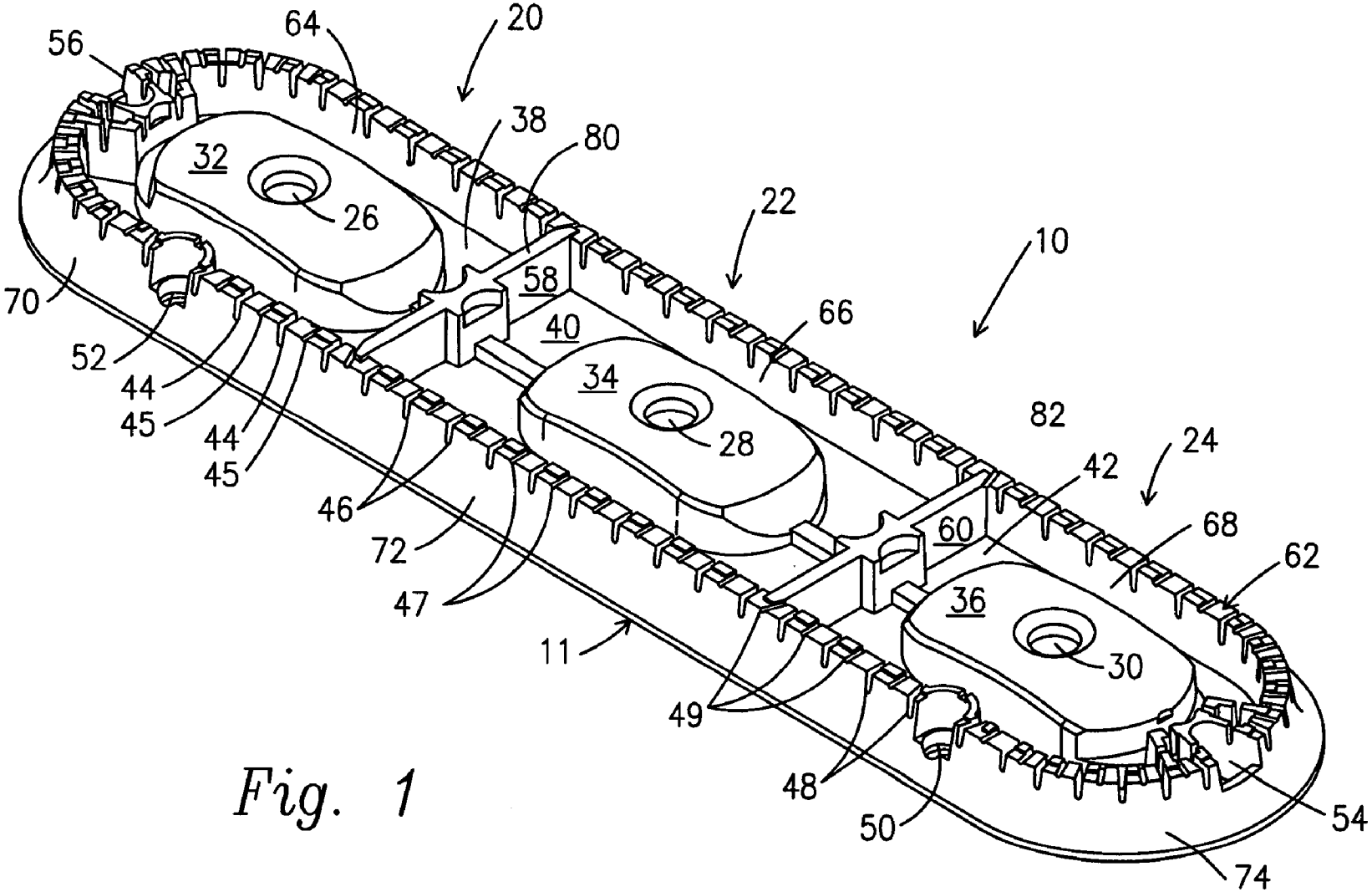
FIG. 1 is a top perspective view of the multiple burner assembly of the presently preferred embodiment of the present invention with the cap removed.
Figure 2:
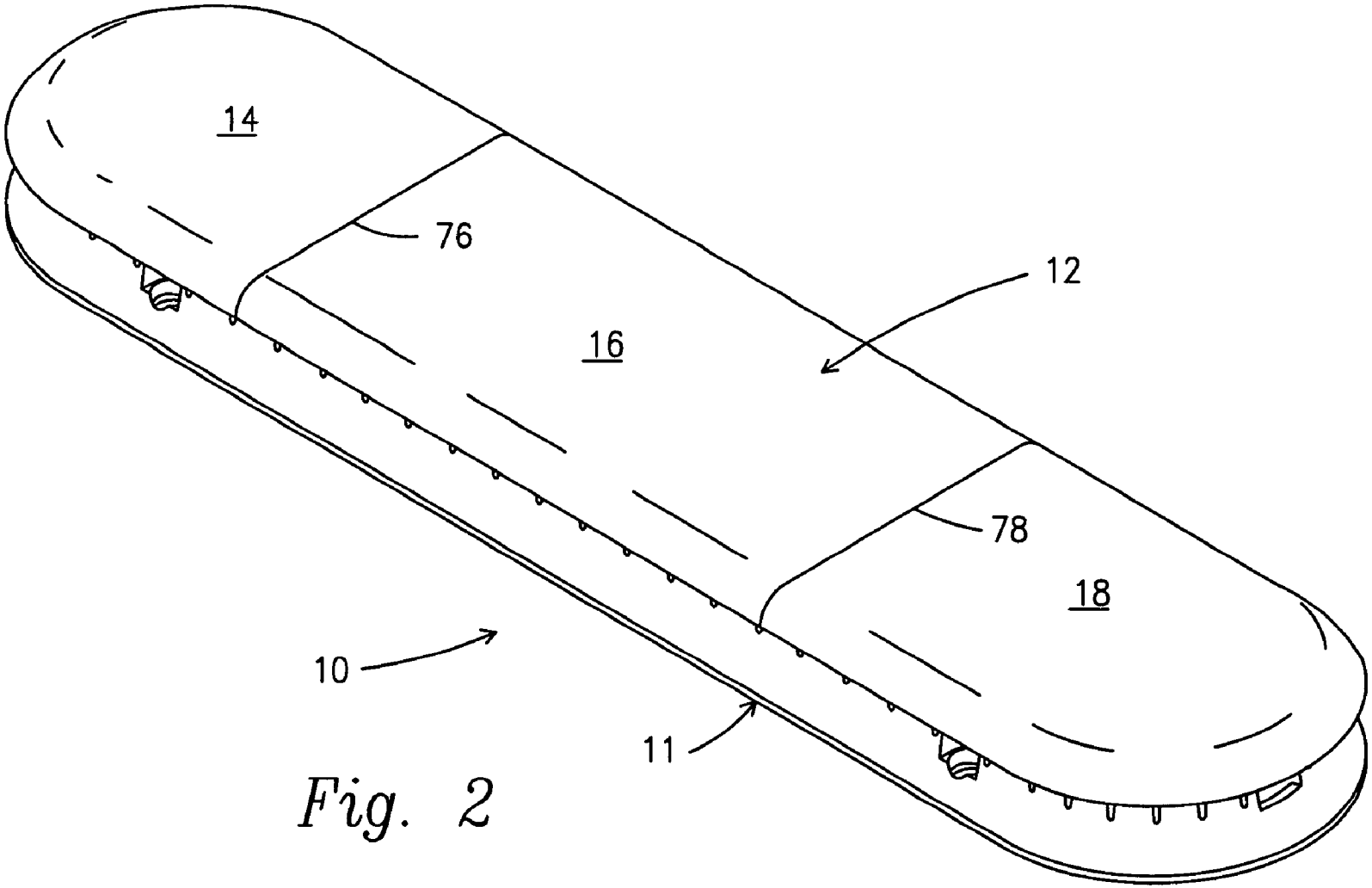
FIG. 2 is a top perspective view of the multiple burner assembly shown in FIG. 1 with the cap installed.

FIGS. 1-4 show the preferred embodiment of a multiple burner assembly 10 with and without the cap 12 (shown installed in FIG. 2). The cap 12 is illustrated divided into first, second and third segments 14,16,18 in FIG. 2, however, a single cap segment could also be utilized. Utilizing multiple segments 14,16,18 has been found to reduce the tendency of the cap 12 to warp or otherwise degrade over the life of its use. Furthermore, in other embodiments, the cap segments 14,16, 18 may or may not contact one another as will be explained in detail below. It is to be understood that a multiple burner assembly 10 includes at least one body 11 and at least one cap 12 as shown in FIG. 2.

The multiple burner assembly 10 preferably has at least three burners 20,22,24. Each of the burners 20,22,24 are provided with a gas supply preferably through an annularly shaped opening 26,28,30. A gas supply assembly, a device known in the art, is normally provided as a unit containing a valve and possibly a thermocouple and an electric ignition member. The gas supply device provides an air/gas mixture through the openings 26,28,30. The air/gas mixture is directed through the openings 26,28,30 across the top surfaces 32,34,36 which cooperate with a lower surface (obscured from view) of the cap segments 14,16,18 to preferably define a convergent-divergent space intermediate the cap segments 14,16,18 and top surfaces 32,34,36. This provides a venturi effect drawing the air gas mixture from the gas supply 26,28,30 into the chambers 38,40,42 internal of the burners 20,22,24. This flow of air is known in the art and is shown in relation to a shot or vertical venture burners in co-owned U.S. Pat. No. 4,773,383, and in relation to horizontal pipe venture burners in U.S. Pat. No. 6,030,207.

Once the air/gas mixture has reached the chambers 38,40, 42, it is then primarily directed out flame ports 44,46,48 respectively. Ducts 45,47,49 are also illustrated and are utilized as is known in the art. Ducts 45,47,49 are not meant to be included as flame ports 44,46,48 throughout this disclosure. When an ignition device, such as an electronic igniter, is positioned in igniter receivers 50,52, then the air/gas mixture flowing from the flame ports 44,46,48 may be lit. Different types of igniters and different igniter positions may also be utilized to light the gas/air mixture. Separation chambers 54,56 may be used to ensure that a sudden change in air pressure does not extinguish the flames provided through the flame ports 44,46,48 as has been explained in co-owned U.S. Pat. No. 5,133,658.

Baffles 58,60 are illustrated separating the chambers 38,40, 42 of the burners 20,22,24 from one another. The baffles prevent the communication of the air/gas mixture from one burner 20,22,24 to another, while allowing efficient production of the multiple burner assembly as a single casting. As will be explained in reference to FIGS. 12-13, other embodiments having entirely separate burners may also be utilized. Furthermore, the burners, whether in unitary or modular configuration, may be of either removable construction or non-removable construction designed to be anchored to the cooktop.

The flame ports 44,46,48 are preferably located around a track 62 defining a perimeter of the flame ports 44,46,48. The track 62 in the preferred embodiment can be defined by the cross section of the exterior walls 64,66,68 that cooperate with the baffles 58,60 to define the chambers 38,40,42 therein. The walls 64,66,68 extend from bases 70,72,74. The flame ports 44,46,48 extend, preferably as channels, through the walls 64,66,68. The body 11 of multiple burner assembly 10 may be manufactured from a single cast piece as in the preferred embodiment, or may be assembled of distinct pieces that are then mounted either contiguously or separately depending upon the embodiment selected.

FIG. 2 shows the multiple burner assembly 10 with the cap 12 installed on the body 11. The cap segments 14,16,18 are illustrated as meeting at interfaces 76,78 so that the relatively long cap 12 may be less susceptible to warping over time. The upper surfaces of these segments 14,16,18 are preferably enameled to assist in maintaining the cleanliness of the multiple burner assembly 10 with the cap 12. The interfaces 76,78 are illustrated as extending directly above top ridges 80,82 of the baffles 58,60. This both prevents leakage of gas between the segments and reduces the likelihood of fouling the chambers 38,40,42 with foreign material, such as spills that may occur during cooking. In other embodiments the segments 14,16,18 may be spaced apart from one another, especially when the burners 20,22,24 are spaced apart.

Figure 3:
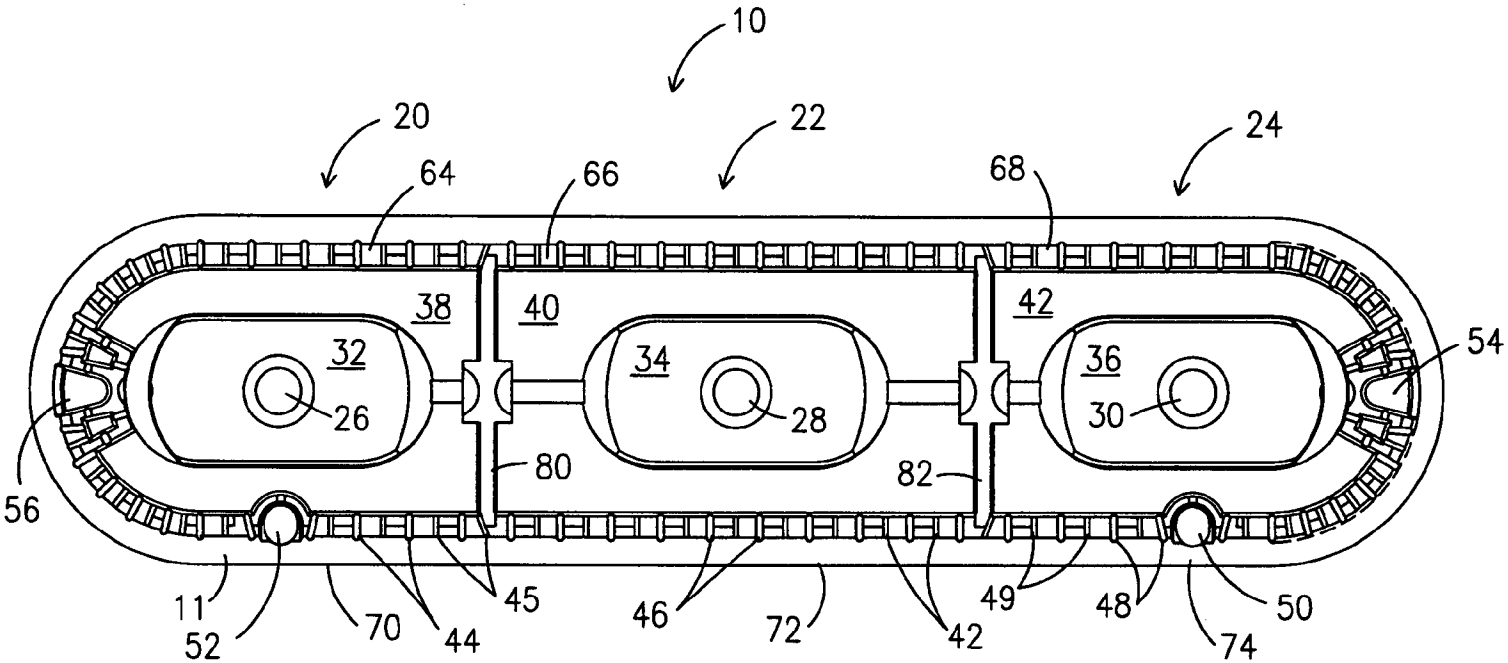
FIG. 3 is a top plan view of the multiple burner assembly shown in FIG. 1.
Figure 4:
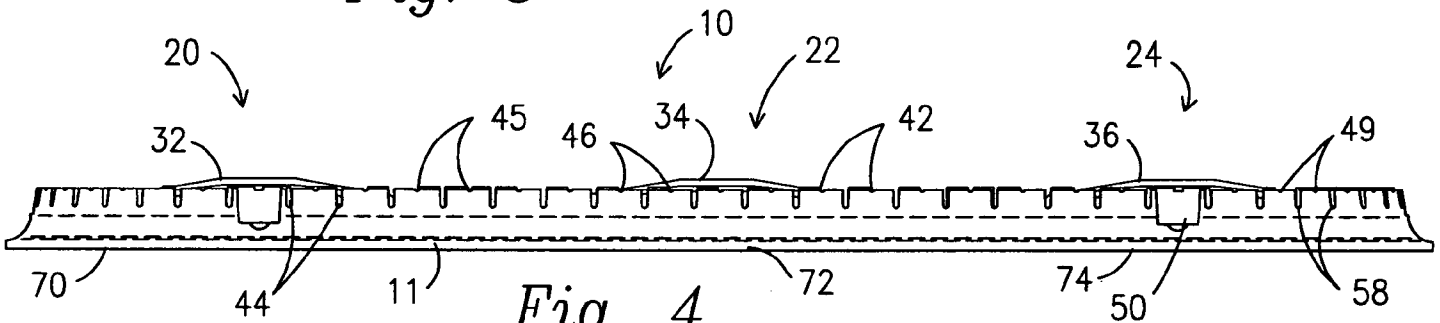
FIG. 4 is a side plan view of the multiple burner assembly shown in FIG. 1.
Figure 5:
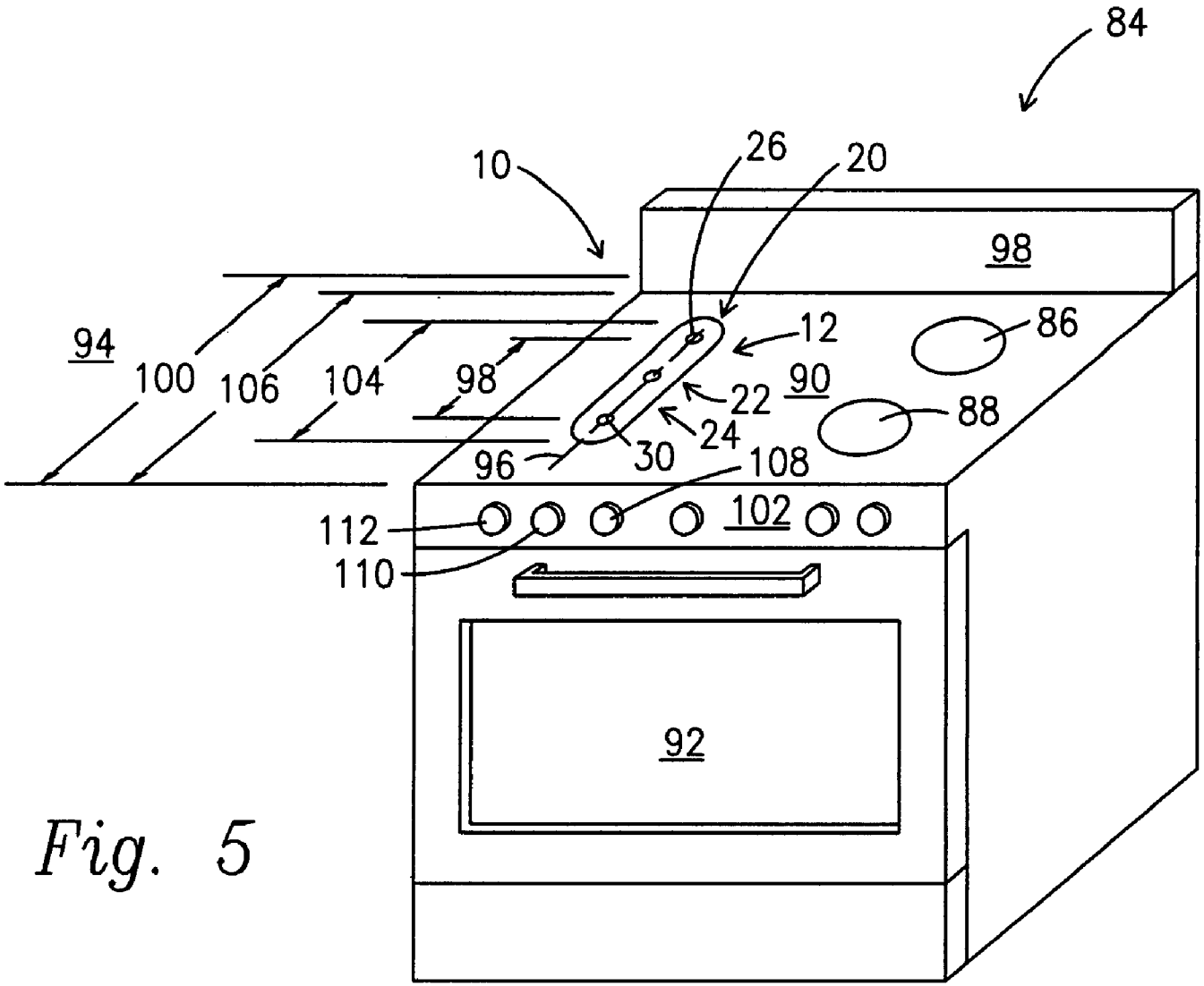
FIG. 5 is a top perspective view of the multiple burner assembly installed on a cooker.

FIG. 5 shows a gas stove 84 having two conventional gas burners 86,88, the cooking grates having been removed for ease of viewing the burners 86,88. Grates are normally suspended above the burners 86,88 to provide a surface to hold pots, griddles, pans, woks, or other cooking utensils. The multiple burner assembly 10 is shown to the left of the conventional burners 86,88. Once again, cooking grates would typically be utilized above the multiple burner assembly 10. While the cook top 90 is shown in FIG. 3 as a portion of a stove 84, other cook tops 90 are not connected to an oven 92 and can be separately mounted within a counter top 94.

In FIG. 5, the three burners 20,22,24 and burner supplies 26,28,30 (shown in phantom) are aligned in a substantially linear and symmetrical arrangement along and about axis 96. Non-linear and non-symmetrical arrangements may also be utilized in some embodiments without departing from the spirit of the invention. Axis 96 is preferably oriented to be perpendicular to the plane of the backsplash 98. The axis 96 is illustrated extending to the depth of the counter top 94. While the burner supplies 26,28,30 are preferably linearly aligned along axis 96, an alternative alignment would be perpendicular to the illustrated axis 96, so that instead of being aligned from front to back on the cooker, the burners of the invention would proceed from side to side.

Since most residential countertops 94 have a distance along axis 96 of approximately twenty-four inches represented as width 100, it has been found that in order to pass safety tests, the flame ports 48 of the third burner 30 closest to the front edge 102 must be spaced at least four if not five inches along axis 96. The burner supplies 26,28,30 (shown in phantom in FIG. 5) are illustrated with a maximum separation distance 98 from the first burner supply 26 to third burner supply 30. Generally, this maximum separation distance will not exceed about twelve inches.

It has been found that the space in between front and back burner supplies 26,30 is preferably about nine inches for a separation distance 98. Separation distances of over twelve inches or less than six inches are not particularly practical due to the size of residential cook tops and the need for the front and back burners to be suitable for heating separate cooking utensils. Greater separation distances may be appropriate for larger or commercial cooktops.

Figure 6:
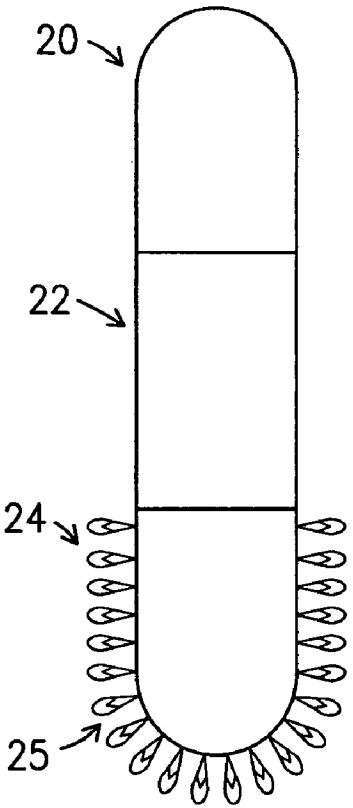
FIG. 6 is a top schematic view of the multiple burner assembly showing only the first burner alit.

FIGS. 6-9 show possible modes of operation of a preferred embodiment of a multiple burner assembly 10. In FIG. 6, only the third burner 24 is ignited with flames emitting from the flame ports (obscured from view). While FIG. 6 shows the third burner 24 ignited, with separate gas supplies and controls, any of the three burners may be separately ignited. Typically, the first burner 20 and third burner 24 which are in generally the conventional burner locations for a cook top, would be utilized separately. In FIG. 5, controller 108 regulates the flow of gas to the third burner 24. An igniter located in the igniter receiver 50 is controlled with the gas/air mixture provided to the burner 24 by the controller 108 so that upon initiation of gas flow to the burner 24, the air/gas mixture is ignited by the igniter (not shown). A first flame perimeter 25 is illustrated in FIG. 6 about the third burner 24. The first flame perimeter 25 would typically be capable of providing about 4000 to 12000 BTUs on high and be suitable for heating a pot or other cooking utensil, however, any BTU capacity suitable for heating may be used.

Figure 7:
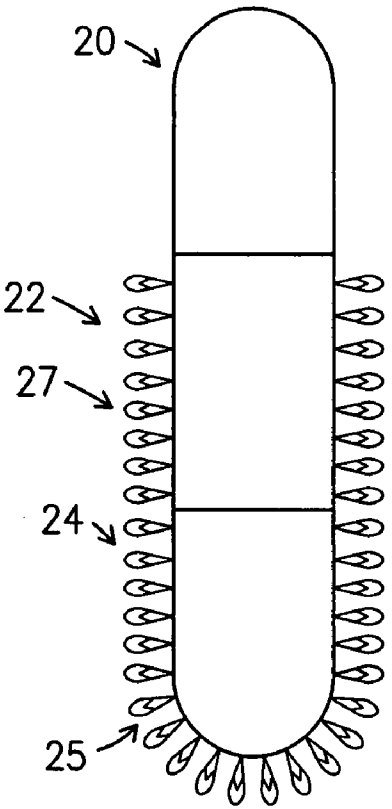
FIG. 7 is a top schematic view showing the first and second burner lit.

In FIG. 7, both the second and third burners 22,24 are shown ignited. The second burner would typically also be capable of providing at least about 4000 BTUs on high however, a burner with any BTU capacity suitable for heating may be used. First and second flame perimeters 25,27 combine to form third flame perimeter 31. Third flame perimeter 31 is comprised of at least portions of first and second flame perimeters 25,27. Although the flame height is shown as being uniform in FIGS. 6-9, the gas flow may be varied among the separate burners 20,22,24 and the flame heights need not be the same. The third flame perimeter is suitable for heating a moderately sized oval pan or other similarly configured cooking utensils.

The flame heights of FIGS. 6-9 are illustrative in nature and may vary in intensity and angular relationship relative to the burner assembly 10. The gas flow in FIG. 7 may be established through the use of separate controllers 108 and 110. Alternatively, controller 110 may be omitted and controller 108 constitute a dual valve controller so that the gas flow in burner 24 alone is controlled by rotating the controller through a defined arc, such as 150 degrees of rotation, and the gas flow of both burners 22 and 24 as shown in FIG. 7 is controlled through the rotation of the same controller 108 through a further defined arc of rotation. When using a dual valve controller, there is no requirement for an igniter in the second burner 22 as gas from the second burner 22 will necessarily be ignited by flames from the third burner 24, so long as the burners are proximately located to one another. However, in other embodiments separate igniters may also be utilized with the second and third burners 22,24 as with the first burner 20. By providing flames from both the second and third burners 22,24 the operator is able to extend the flame perimeter beyond that of first flame perimeter 25 shown in FIG. 6.

Figure 8:
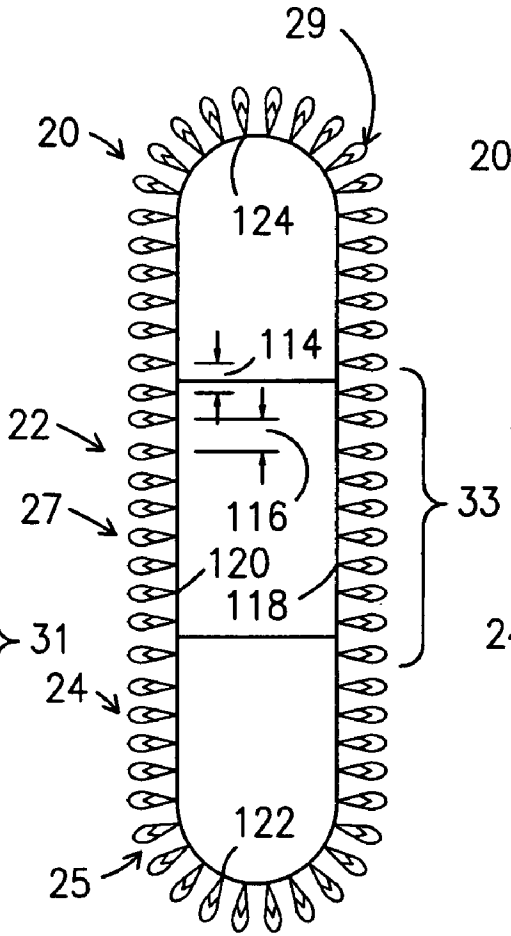
FIG. 8 is a top schematic view showing the first, second and third burners lit.

In FIG. 8, the first burner 20 is provided with an air/gas mixture along with second and third burners 22,24, thus providing a continuous flame perimeter. It is preferred that the flames emitted by the individual burners 20,22,24 not interfere with flames produced by the adjacent proximate burners. Controller 112 may be utilized to control the first burner 20 as shown in FIG. 5. The flame perimeters 25,27,29 of each of the three burners 20,22,24 are additive as shown in FIGS. 6-8 when utilized in this manner. Namely, the third perimeter 31 shown in FIG. 7 is comprised of first perimeter 25 and second perimeter 27. In FIG. 8, the fifth perimeter 33 is comprised of at least portions of first perimeter 25, second perimeter 27 and fourth perimeter 29. This fifth perimeter 33 is suitable for providing relatively even heating under a griddle, roasting pan, fish kettle, or other cooking utensils more than one foot in length.

FIG. 8 shows the adjacent flame spacing 114 between burners as substantially equal to the intermediate flame spacing 116 between adjacent burners, referred to as intermediate flame spacing 116. This provides the illusion that a single burner is providing the gas flow as shown in FIG. 8. Generally, the adjacent flame spacing is reduced when it is desired that the flames emitted from flame ports be relatively compact, and adjacent flame spacing is increased when it is desired that flames extend outward from the burner to a greater length. According to the present invention, it is desirable that the intermediate flame spacing 116 between adjacent burners be on the same order of magnitude as the adjacent flame spacing 114, such that a flame from one burner will ignite gas issuing from the adjacent burner.

Figure 9:
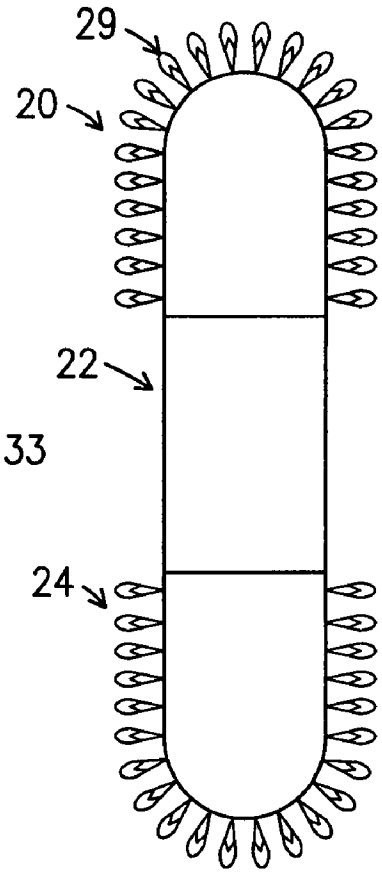
FIG. 9 is a top schematic view showing the first and third burners lit.

Finally, in FIG. 9, the first and third burners 20,24 are shown lit with the second burner 22 off. In this manner, the multiple burner assembly 10 is suitable for utilization as two conventional burners and two separate cooking utensils such as pots may be placed respectively above each separate burners 20,24. In addition, as first and third burners 20,24 are independently controlled from separate controllers 108,112, the flame height and heat output applied by each burner need not be the same. First burner 20 may also be operated alone as a conventional burner to heat a single cooking utensil.

Figure 10:
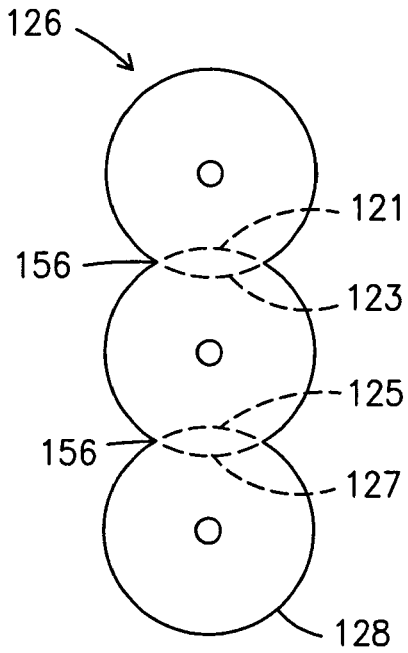
FIG. 10 is a top plan view of a first alternative embodiment of the multiple burner assembly.

Alternative bridged burner embodiments are shown in FIGS. 10 through 13. In FIG. 10, there are no linear segments 118,120 of the multiple burner assembly 126, as illustrated in FIG. 8. All of the segments of the perimeter 128 are curved. Phantom interior segments 121,123,125,127 illustrate preferred locations for baffles within the burner assembly, and only one of the pairs of curved segments 121,123 or 125,127 need be present. The intersection 156 of the curved segments of burner 26 requires adjustments to the spacing and orientation of the flame ports to minimize interference between flames that are aimed in intersecting directions.

The flame perimeters 25,27,29 of each of the three burners 20,22,24 are additive as shown in FIG. 6-8 when utilized in this manner. Namely, the third perimeter 31 shown in FIG. 7 is comprised of at least portions of first perimeter 25 and second perimeter 27. At FIG. 8, the third perimeter 33 is comprised of at least portions of first perimeter 25, second perimeter 27 and fourth perimeter 29. In fact, in the preferred embodiment, the third perimeter 31 is completely formed by the first and second perimeters 25,27, i.e., the length of the perimeter 31 is substantially equal to the lengths of the first and second perimeters 25,27 added together. The same is true for the fifth perimeter 33 shown in FIG. 8 being the sum of the lengths of the first, second and fourth perimeters 25, 27, 29.

Figure 12:
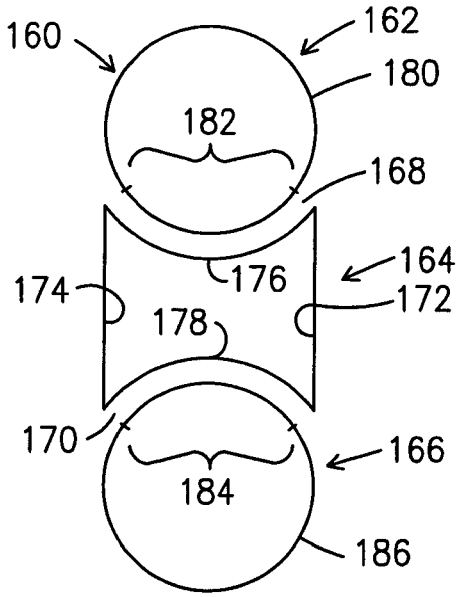
FIG. 12 is a top plan view of a third alternative embodiment of the multiple burner assembly.
Figure 13:
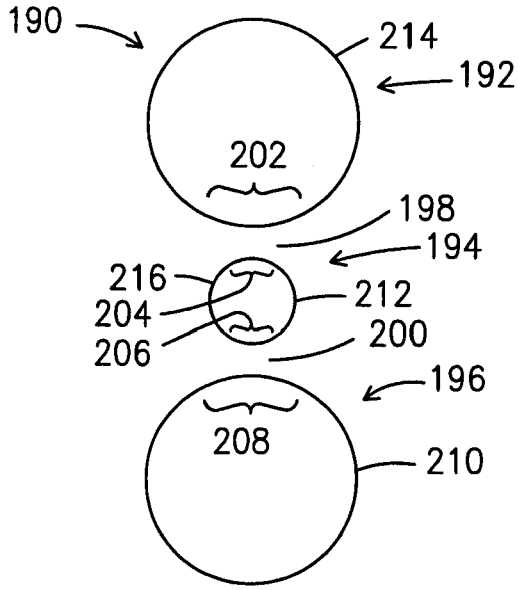
FIG. 13 is a top plan view of a fourth alternative embodiment of the multiple burner assembly.

As can be seen in the alternative embodiments of FIGS. 12-13, this may or may not be the case depending upon whether inner intermediate faces between burners are ignited. Furthermore, since the first, second and third burners may be spaced apart as shown in the alternative embodiments, the perimeter lengths may be affected.

Figure 11:
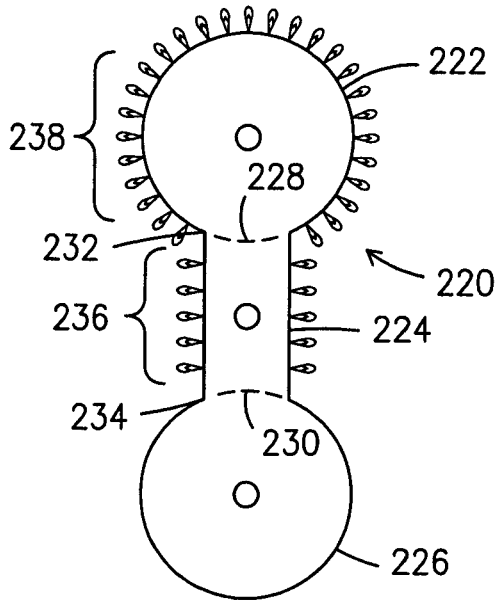
FIG. 11 is a top plan view of a second alternative embodiment of a multiple burner assembly.

Alternative embodiment burner 220 shown in FIG. 11 is another integral three burner design in a barbell configuration. First burner 222 is connected by a bar shaped second burner 224 to a third burner 226. This configuration has the advantage of permitting the first and third burners 222,226 to have flame patterns that encompass a greater arc than the first and third burners 220,224 of the embodiment of FIG. 9. It will be seen that only segments 228,230 of first and third burners 222,226 will be completely without flame ports. These portions of the first and third burners 220,224 also represent preferred placement for baffles to separate the chambers of first, second and third burners 222,224,226. In order to minimize interference of flames 238 from first burner 222 with flames 236 of second burner 224, there is preferably a segment 232 of the second burner 224 in which no flame ports are located. In addition, flame ports of first burner 222 may be closely spaced in the portions adjacent to second burner 224 so that the flames from these ports do not extend substantially from burner 222. A similar absence of flame ports on segment 234 of second burner 224 adjacent to third burner 226 is also illustrated.

FIG. 12 is another alternative of a multiple burner assembly 160. Three separate burners 162,164,166 make up multiple burner assembly 160. In this design, the second burner 164 has opposed linear sides 172,174 and concave segments 176, 178. This embodiment may operate in a similar manner as the embodiments in FIGS. 9-10. Specifically, the curved segment 180 of the first burner 162 may be distinguished from the arc segment 182 which faces the concave segment 176 of second burner 164. Similarly, arc segment 184 of the third burner 166 faces the concave segment 178 of the second burner 164. Curved segment 186 completes the perimeter of the third burner 166. Accordingly, the arc segments 182,184 may be made without flame ports so that no flame is directed toward the second burner 164. In this case, concave segments 176, 178 might or might not be provided with flame ports.

Alternatively, and most typically, the concave segments 176,178 of the second burner 164 may not be provided with flame ports. In that case, the arc segments 182,184 of the first and third burners 162,166 may be provided with flame ports, which typically would be closely spaced to minimize the extension of the flames from arc segments 182,184 outward from first and third burners 162,166. According to this design, the first and third burners would provide a complete circumference of flame perimeter, giving not only the effect but also the appearance of a conventional burner.

Independent operation of the burners in the manner described in connection with the embodiment of FIG. 1, permits the use of first and third burners 162,166 in a conventional fashion and the use of second burner 164 as a bridge burner when desired for particular cooking utensils.

FIG. 13 shows another multiple component burner embodiment 190 having first, second and third burners 192, 194,196. The three burners 192,194,196 are spaced apart by channels 198,200. In this embodiment, as in the embodiment of FIG. 12, care must be taken with opposing arc segments 202,204 and 206,208 respectively as they direct flame toward one another. Generally, either one of each pair of the opposing arc segments will have no flame ports, or both opposing arc segments will have relatively closely spaced flame ports to minimize the distance the resulting flames protrude outward from the burner. Accordingly, in one method of operating the embodiment of FIG. 13, flame may extend outward around the entire perimeters of each of first, second and third burners 192,194,196.

As can be seen from the preferred embodiment and alternative embodiments shown in FIGS. 6-17, the second burners 22, not identified in FIG. 10 but shown as 164,194 and 224 in FIGS. 11-17, operate as bridge burners. These burners provide a way of bridging the first and third burners of each of these embodiments with an intermediate flame perimeter to span between the first and third burners. Pots large enough to be heated by the first and third burners may also be heated by the bridge burner if so desired. The bridge burners shown in FIGS. 6-17 provide a means for heating intermediate the spaced apart first and third conventional burners to provide at least a relatively continuous perimeter of flame, and an axis of relatively continuous heating, from the first to the third burners.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed is:

1. A multiple burner assembly comprising:

a first burner having a first gas supply to a first chamber defined in part by a first wall and a first removable cap, and a plurality of flame ports located about a portion of a perimeter of the wall of the first burner with said cap extending cantileveredly beyond the first wall and first chamber and over the plurality of flame ports;

a second burner proximate to the first burner having a second gas supply to a second chamber defined in part by a second wall and a removable second cap, and a plurality of flame ports located about a portion of a perimeter of the wall of the second burner with said cap extending cantileveredly beyond the second wall and second chamber and over the plurality of flame ports, said second burner non-concentrically located relative to the first burner; and a third burner proximate to the second burner having a third gas supply to a third chamber defined in part by a third wall and a third removable cap, and a plurality of flame ports located about a portion of a perimeter of the wall of the third burner with said cap extending cantileveredly beyond the third wall and third chamber and over the plurality of flame ports, said third burner non-concentrically located relative to the first and second burners;

said second burner being intermediate the first and third burners wherein when the first, second and third burners are lit, at least a substantial portion of the flame ports of the first, second and third burners cooperate to form a substantially continuous flame perimeter about the first, second and third burners with the flame ports of the second burner forming two segments which extend from toward the first to toward the third burners with the two segments spaced apart from each other by the cap of the second burner;

wherein the first and second burners meet at a first baffle, the first and second caps extend over and abut atop a first retaining ridge on the first baffle, the second and third burners meet at a second baffle and the second and third caps extend over and abut atop a second retaining ridge on the second baffle with said first, second and third caps providing a larger perimeter than a perimeter of the flame ports of the first, second and third flame ports.

2. The multiple burner assembly of claim 1 wherein the first and second burners have a first and a second base, respectively and the first and second bases are integrally formed.

3. The multiple burner assembly of claim 1 wherein the first, second and third burners have a first base, a second base and a third base respectively, and the first, second and third bases are integrally formed.

4. The multiple burner assembly of claim 1 wherein the first and second burners produce first and second flame perimeters, respectively, when lit, and a third perimeter is comprised of the first and second flame perimeters with the third perimeter having a distance substantially equal to the sum of distances of the first and second perimeters.

5. The multiple burner assembly of claim 4 wherein the third burner produces a fourth flame perimeter when lit, and a fifth flame perimeter is comprised of the first, second and fourth perimeters with the fifth perimeter having a distance substantially equal to the sum of distances of the first, second and fourth perimeters.

6. The multiple burner assembly of claim 1 wherein the first burner produces a first flame perimeter and the third burner produces a fourth flame perimeter, and said first and fourth flame perimeters are separate and adapted for the heating of separate cooking utensils.

7. The multiple burner assembly of claim 5 wherein the fifth flame perimeter provides substantially continuous heating over a length of at least about twelve inches.

8. A multiple burner assembly comprising:

a generally ovular base having a major axis and a minor axis;

an ovular perimeter wall upstanding from the base having flame ports therein;

baffles extending across the ovular base and wall structure generally perpendicular to the major axis, and defining first, second and third chambers;

first, second and third openings in the base within first, second and third chambers respectively; and first, second and third removable caps mounted over at least a portion of the wall flame ports, and over at least a portion of the baffles to enclose the first, second, third chambers, respectively, with the at least one cap extending cantileveredly beyond the outer perimeter wall, and forming a continuous cap when installed, wherein the first and second burners meet at a first baffle, the first and second caps extend over and abut atop a first retaining ridge on the first baffle, the second and third burners meet at a second baffle and the second and third caps extend over and abut atop a second retaining ridge on the second baffle with said first, second and third caps providing a larger perimeter than a perimeter of the flame ports of the first, second and third flame ports.

9. The multiple burner assembly of claim 8 wherein the base, wall and baffles are integrally formed.

10. A cooker with a gas burner assembly comprising:

a first burner having a first gas supply to a first chamber defined in part by a first wall, and a plurality of flame ports located about a portion of a perimeter of the first wall of the first burner;

a second burner proximate to the first burner having a second gas supply to a second chamber defined in part by a second wall, and a plurality of flame ports located about a portion of a perimeter of the second wall of the second burner, and a first baffle separating the first burner from the second burner and having a first retaining ridge on top thereof;

a third burner proximate to the second burner having a third gas supply to a third chamber defined in part by a third wall, and a plurality of flame ports located about a portion of a perimeter of the third wall of the third burner;

a second baffle separating the second burner from the third burner and having a second retaining ridge on top thereof;

said second burner being intermediate the first and third burners; wherein when the first, second and third burners are lit, at least a portion of the flame ports of the first, second and third burners cooperate to form a flame perimeter about the first, second and third burners and an axis of relatively continuous heating extending through the first and the third burners with the second burner having first and second segments providing the plurality of flame ports progressing in a direction parallel to axis with the first and second segments spaced on opposite sides of the axis;

and first, second and third removable caps over the first, second and third burners assisting in defining the first, second and third chambers, respectively, with the at least one cap extending cantileveredly beyond the flame ports, and over the first and second baffles wherein the first and second burners meet at a first baffle, the first and second caps extend over and abut atop the first retaining ridge, the second and third burners meet at a second baffle and the second and third caps extend over and abut atop the second retaining ridge, and said first, second and third caps providing a larger perimeter than a perimeter of the flame ports of the first, second and third flame ports.

11. The cooker of claim 10 further comprising a first igniter operable with the first burner;

a first controller for supplying gas to the first burner;

a second igniter operable with the third burner; and a second controller for supplying gas to the second burner and the third burner independently of the first burner.

12. The cooker of claim 10 further comprising a first igniter operable with the first burner and a first controller for supplying gas to the first burner;

a second igniter operable with the second burner and a second controller for supplying gas to the second burner; and a third igniter operable with the third burner and a third controller for supplying gas to the third burner.

13. The cooker of claim 11 in combination with a substantially planar backsplash at an upper surface of a range, wherein said first, second and third burners are located at an upper surface of the range and along an axis extending substantially perpendicular to the backsplash.

14. A cooker having a multiple burner assembly comprising:

a first burner having a gas supply and a first control means for igniting and adjusting the flow of gas to the first burner;

a second burner having a gas supply and a second control means for igniting and adjusting the flow of gas to the second burner, said first and second burners being spaced apart for the heating of separate cooking utensils; and a bridge burner intermediate and separated by baffles from said first and second burners for providing an axis of relatively continuous heating from the first burner to the second burner with the bridge burner having two segments of flame orifices oppositely disposed relative to the axis extending intermediate the first and second burner and first, second and third removable caps a extending cantileveredly over and beyond the flame orifices in a direction perpendicular to the axis, said first, second and third removable caps at least partially covering the flame orifices, and wherein the first and second burners meet at a first baffle, the first and second caps extend over and abut atop a first retaining ridge on the first baffle, the second and third burners meet at a second baffle, and the second and third caps extend over and abut atop a second retaining ridge on the second baffle with said first, second and third caps providing a larger perimeter than a perimeter of the flame ports of the first, second and third flame ports.

15. The cooker of claim 14 wherein the second control means adjusts the flow of gas to the bridge burner, and flames from the second burner are sufficiently proximate the bridge burner to ignite gas from said bridge burner means.

16. The cooker of claim 14 wherein the bridge burner has a gas supply and a third control means for igniting and adjusting the flow of gas to the bridge burner.

17. The cooker of claim 14 further comprising a backsplash wherein said first burner, bridge burner and second burner are at an upper surface of the cooker and extend generally along an axis oriented substantially perpendicular to the backsplash.

* * * * *